US010317165B2

(12) United States Patent
Saltzman

(10) Patent No.: US 10,317,165 B2
(45) Date of Patent: Jun. 11, 2019

(54) MODULAR CHASSIS/STOCK SYSTEM FOR A FIREARM

(71) Applicant: Randall J. Saltzman, Tipton, IN (US)

(72) Inventor: Randall J. Saltzman, Tipton, IN (US)

( * ) Notice: Subject to any disclaimer, the term of this patent is extended or adjusted under 35 U.S.C. 154(b) by 16 days.

(21) Appl. No.: 15/703,479

(22) Filed: Sep. 13, 2017

(65) Prior Publication Data

US 2018/0073835 A1 Mar. 15, 2018

Related U.S. Application Data

(60) Provisional application No. 62/394,894, filed on Sep. 15, 2016.

(51) Int. Cl.
*F41C 7/00* (2006.01)
*F41C 23/08* (2006.01)
*F41C 23/14* (2006.01)

(52) U.S. Cl.
CPC ..... *F41C 23/08* (2013.01); *F41C 23/14* (2013.01); *F41C 7/00* (2013.01)

(58) Field of Classification Search
CPC ..... F41C 23/08; F41C 23/14; F41C 7/00
See application file for complete search history.

(56) References Cited

U.S. PATENT DOCUMENTS 3,137,958 A * 6/1964 Lewis ..... F41C 23/14 42/73
3,604,138 A * 9/1971 Wilson ..... F41C 23/06 42/74
3,707,797 A * 1/1973 Ruth ..... F41C 23/06 42/74
5,031,348 A * 7/1991 Carey ..... F41C 23/06 42/71.01
5,410,833 A * 5/1995 Paterson ..... F41C 23/06 42/73
6,481,142 B1 * 11/2002 McCarthy ..... F41C 23/06 42/74
7,380,487 B2 * 6/2008 Mantras ..... F41A 3/86 42/1.06
D623,718 S 9/2010 Peterson et al.
7,823,318 B2 11/2010 Hall
D643,085 S 8/2011 Peterson et al.
D643,086 S 8/2011 Peterson et al.
D645,532 S 9/2011 Peterson et al.
D645,533 S 9/2011 Peterson et al.
D646,745 S 10/2011 Peterson et al.
D657,841 S 4/2012 Peterson et al.
8,186,090 B1 * 5/2012 Chiarolanza ..... F41C 23/14 42/73
8,205,371 B1 * 6/2012 Cook ..... F41A 25/10 42/1.06
D676,095 S 2/2013 Peterson et al.
8,429,844 B2 4/2013 Dextraze et al.
8,464,458 B2 * 6/2013 Chvala ..... F41C 23/04 42/73

(Continued)

*Primary Examiner* — Michelle Clement
(74) *Attorney, Agent, or Firm* — Taft Stettinius & Hollister LLP

(57) ABSTRACT

The present disclosure generally is related to a modular chassis/stock system for a rifle type firearm that incorporates a recoil reduction assembly. The chassis/stock system includes a buttstock assembly that is configured to include an elongated housing for receiving a mounting body of the recoil reduction assembly.

12 Claims, 8 Drawing Sheets

(56) References Cited

U.S. PATENT DOCUMENTS 8,656,622 B2 * 2/2014 Peterson ..... F41A 11/02 42/124
D705,885 S 5/2014 Peterson et al.
8,832,984 B1 9/2014 Vesligaj
D728,722 S 5/2015 Peterson et al.
D728,723 S 5/2015 Peterson et al.
9,021,728 B1 5/2015 Kocmich, IV et al.
D744,054 S 11/2015 Peterson et al.
9,239,203 B2 1/2016 Jarboe et al.
9,395,148 B1 7/2016 Huang
9,448,034 B2 9/2016 Downey et al.
10,006,739 B2 * 6/2018 Pollutro ..... F41C 23/06
10,101,116 B2 * 10/2018 Kronsteiner ..... F41C 23/06
2002/0053156 A1 * 5/2002 McCarthy ..... F41C 23/06 42/74
2003/0154640 A1 * 8/2003 Bragg ..... F41C 23/08 42/74
2003/0221352 A1 * 12/2003 Steele ..... F41C 23/14 42/73
2006/0096148 A1 * 5/2006 Beretta ..... F41C 23/06 42/74
2006/0168869 A1 * 8/2006 Daul ..... F41C 23/08 42/74
2007/0056202 A1 * 3/2007 Oz ..... F41A 23/02 42/94
2007/0101631 A1 * 5/2007 Bentley ..... F41C 23/14 42/74
2007/0261284 A1 * 11/2007 Keng ..... F41C 23/04 42/73
2008/0028662 A1 * 2/2008 Abraham ..... F41C 23/14 42/73
2008/0110074 A1 * 5/2008 Bucholtz ..... F41C 23/06 42/1.06
2008/0178508 A1 * 7/2008 Cinciu ..... F41C 23/06 42/1.06
2009/0077852 A1 * 3/2009 Steimke ..... F41A 3/50 42/39.5
2009/0288324 A1 * 11/2009 Peterson ..... F41A 11/02 42/75.03
2010/0050492 A1 * 3/2010 Faifer ..... F41A 3/82 42/1.06
2010/0071246 A1 * 3/2010 Vesligai ..... F41C 23/04 42/75.03
2010/0122482 A1 * 5/2010 Simms ..... F41C 23/08 42/1.06
2010/0242328 A1 * 9/2010 Faifer ..... F41C 23/06 42/1.06
2010/0242333 A1 * 9/2010 Kincel ..... F41C 23/04 42/73
2010/0242334 A1 * 9/2010 Kincel ..... F41C 23/04 42/74
2010/0251588 A1 * 10/2010 Kincel ..... F41A 3/84 42/1.06
2010/0281727 A1 * 11/2010 Quaedpeerds ..... F41C 23/06 42/1.06
2012/0137561 A1 * 6/2012 Ludlow ..... F41C 23/04 42/75.03
2012/0144712 A1 * 6/2012 Rostocil ..... F41A 9/79 42/16
2012/0180353 A1 * 7/2012 Holmberg ..... F41A 3/84 42/1.06
2013/0145668 A1 * 6/2013 Valin ..... F41C 23/08 42/74
2013/0180148 A1 * 7/2013 Rogers ..... F41C 23/04 42/73
2013/0212920 A1 * 8/2013 Law ..... F41C 23/14 42/75.03
2014/0075798 A1 * 3/2014 Kincel ..... F41A 3/84 42/1.06
2014/0075801 A1 * 3/2014 Moretti ..... F41C 23/06 42/1.06
2014/0075815 A1 * 3/2014 Jarboe ..... F41C 23/04 42/73
2014/0109452 A1 * 4/2014 Baker ..... F41C 23/06 42/1.06
2014/0190056 A1 * 7/2014 Troy ..... F41C 23/14 42/71.01
2014/0196346 A1 * 7/2014 Grimshaw ..... F41C 23/04 42/73
2014/0250756 A1 * 9/2014 Vesligaj ..... F41C 23/06 42/74
2015/0176944 A1 * 6/2015 Kupanoff ..... F41C 23/14 42/73
2015/0176945 A1 * 6/2015 Simek ..... F41A 3/64 42/75.03
2015/0192380 A1 * 7/2015 Hilsabeck ..... F41A 25/12 42/1.06
2015/0276343 A1 * 10/2015 Zusman ..... F41C 23/04 42/71.01
2015/0338186 A1 * 11/2015 Hopkins ..... F41C 23/14 42/73
2015/0338187 A1 * 11/2015 Priddy ..... F41C 23/22 42/71.01
2015/0345881 A1 * 12/2015 Irvin ..... F41A 3/78 42/1.06
2016/0010944 A1 * 1/2016 Downey ..... F41C 23/06 42/74
2016/0061559 A1 * 3/2016 Wood ..... F41C 23/20 42/73
2016/0116249 A1 * 4/2016 Maugham ..... F41C 23/04 42/74
2016/0116250 A1 * 4/2016 Mather ..... F41C 23/04 42/73
2016/0202016 A1 * 7/2016 Mather ..... F41C 23/14 42/73
2016/0258713 A1 * 9/2016 Huang ..... F41A 3/66
2016/0327362 A1 * 11/2016 Eitan ..... F41C 23/02
2017/0023328 A1 * 1/2017 Irvin ..... F41C 23/04
2017/0067716 A1 * 3/2017 Huang ..... F41C 23/06
2017/0115093 A1 * 4/2017 Chiang ..... F41C 23/06
2017/0122698 A1 * 5/2017 Chu ..... F41C 23/20
2017/0131062 A1 * 5/2017 Wood ..... F41C 23/14
2017/0160047 A1 * 6/2017 Huang ..... F41C 23/04
2017/0167825 A1 * 6/2017 Zusman ..... F41C 23/04
2017/0241738 A1 * 8/2017 Simpson ..... F41C 23/22
2017/0321978 A1 * 11/2017 Brannan ..... F41A 5/28
2017/0321989 A1 * 11/2017 Kronsteiner ..... F41C 23/06
2017/0328672 A1 * 11/2017 Hewes ..... F41C 23/14
2017/0328673 A1 * 11/2017 Law ..... F41A 11/04
2017/0356717 A1 * 12/2017 Pollutro ..... F41C 23/06
2018/0003459 A1 * 1/2018 Miller ..... F41C 23/22
2018/0023918 A1 * 1/2018 Smith ..... F41C 23/04
2018/0058806 A1 * 3/2018 Moody ..... F41C 23/14
2018/0080736 A1 * 3/2018 Olsen ..... F41C 23/14
2018/0180378 A1 * 6/2018 Pretelli ..... F41C 23/04

* cited by examiner

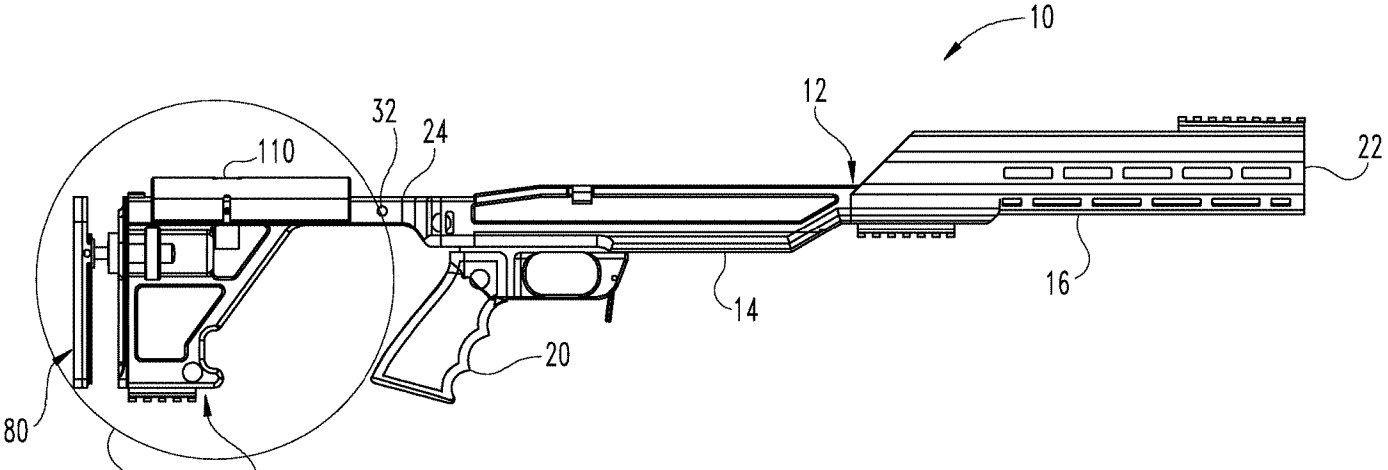
Fig. 1
Fig. 4
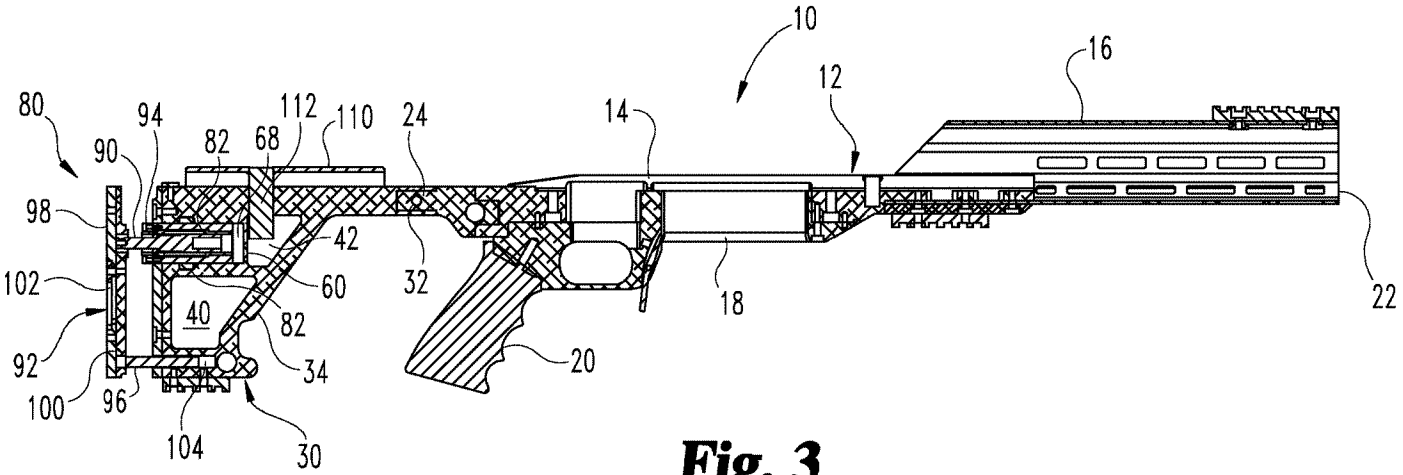
Fig. 3

MODULAR CHASSIS/STOCK SYSTEM FOR A FIREARM

FIELD OF THE INVENTION

The present disclosure is directed generally to firearms and, more particularly, to a modular chassis/stock system for a rifle type of firearm that incorporates a recoil reduction assembly.

BACKGROUND

The firing of a firearm typically results in a recoil caused by the force of the expanding gas propelling a bullet/shot down the barrel. The expanding gases force the firearm rearwardly in a recoil action. Accordingly, most rifle or long gun type firearms subject to substantial recoil include a buttstock for engaging the shooter's shoulder when firing the firearm to help support the firearm during a recoil action.

Recoil reduction devices have been employed with firearms to reduce recoil that is felt by the shooter when the firearm is fired. Reduction in recoil that is felt by the shooter reduces the fatigue of the shooter and also lessens the impacts on the shooter's body. In addition, the shooter is better able to maintain a sight picture to assist in shot identification, to assist in making follow-up shots, and to improve overall shooting performance.

The ability to easily configure a recoil reducing firearm to fit the shooter's needs and anatomy can be useful in several situations, such as in tactical, sniping and target shooting applications. In addition, a buttstock that supports the firearm is desirable where the overall weight of the firearm is minimized while incorporating a recoil reduction system. Accordingly, there remains a need for further improvements in this area.

SUMMARY

The present disclosure generally is related to a modular chassis/stock system for a rifle type firearm that incorporates a recoil reduction assembly. The chassis/stock system includes a buttstock assembly that is configured to include an elongated housing for receiving a mounting body of the recoil reduction assembly. The mounting body houses a recoil strut to which the recoil pad assembly is engaged.

In one embodiment, an adjustment member is threadingly engaged to the mounting body to adjust the length of pull between the recoil reduction assembly and the buttstock assembly. In another embodiment, a shroud is provided around the rearward end of the buttstock that surrounds the recoil pad assembly and recoil strut.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings

BRIEF DESCRIPTION OF THE DRAWINGS

FIG. 1 is an elevation view of a modular chassis/stock system for a firearm including a lower receiver structure, a handguard/accessory rail, and a buttstock assembly that incorporates a recoil reduction assembly.

FIG. 3 is a longitudinal section view along line 3-3 of FIG. 2.

Figure 2:
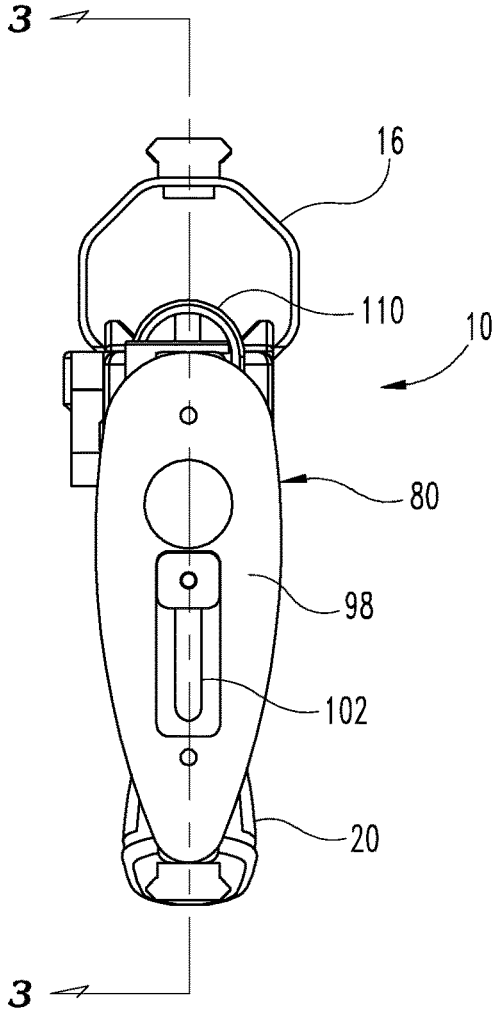
FIG. 2 is a left end elevation view of the part of the modular chassis/stock system of FIG. 1.

Those skilled in the art will appreciate and understand that, according to common practice, the various features of the drawings discussed below are not necessarily drawn to scale, and that dimensions of various features and elements of the drawings may be expanded or reduced to more clearly illustrate the embodiments of the present invention described herein.

DETAILED DESCRIPTION OF THE EXEMPLARY EMBODIMENTS

Referring now to the drawings in which like numerals indicate like parts throughout the several views, the figures illustrate example embodiments of the modular chassis/stock system 10 according to the principles of the present disclosure. Modular chassis/stock system 10 and/or one or more components thereof can be used for various types of firearms, including M4, M16, AR-15, SCAR, AK-47, HK416, ACR, sniper rifles, shotguns, hunting rifles and other long guns, and gas-operated semi-automatic, automatic and manually operable firearms. However, the present disclosure should not be limited to the listed examples.

The following description is provided as an enabling teaching of exemplary embodiments, and those skilled in the relevant art will recognize that many changes can be made to the embodiments described. It also will be apparent that some of the desired benefits of the embodiments described can be obtained by selecting some of the features of the embodiments without utilizing other features. Accordingly, those skilled in the art will recognize that many modifications and adaptations to the embodiments described are possible and may even be desirable in certain circumstances, and are a part of the invention. Thus, the following description is provided as illustrative of the principles of the embodiments and not in limitation thereof.

As shown in FIGS. 1-3, the chassis/stock system 10 generally includes a chassis 12 including a lower receiver 14 and a handguard/rail assembly 16 extending forwardly from lower receiver 14 to a forward end 22 of chassis 12. Typical components that can be provided with or attached to chassis/stock system 10 not shown include an upper receiver mountable to the lower receiver 14 that includes firing control components such as sears and a trigger, a barrel assembly mountable to the upper receiver in handguard/rail assembly 16, a bolt assembly slidably received in the upper receiver for operation of the chassis/stock system 10, and a magazine that is positionable in magazine well 18 that is defined in the chassis 12 and in communication with the chamber for supplying ammunition to the chamber. Chassis 12 includes a pistol-style handgrip 20 adjacent a rearward end 24 of the chassis 12.

In the illustrated embodiment, chassis/stock system 10 includes a buttstock assembly 30 that is mounted to the rearward end 24 of the chassis 12 at a hinge 32. FIG. 1 shows the chassis/stock system 10 in a shooting configuration with the buttstock assembly 30 in an extended position in alignment with the chassis 12, with its hinge blocked or the buttstock assembly 30 otherwise fixed against further pivoting movement. The buttstock assembly 30 can also be moved to a folded position, pivoted forwardly toward the receiver 14.

Figure 4:
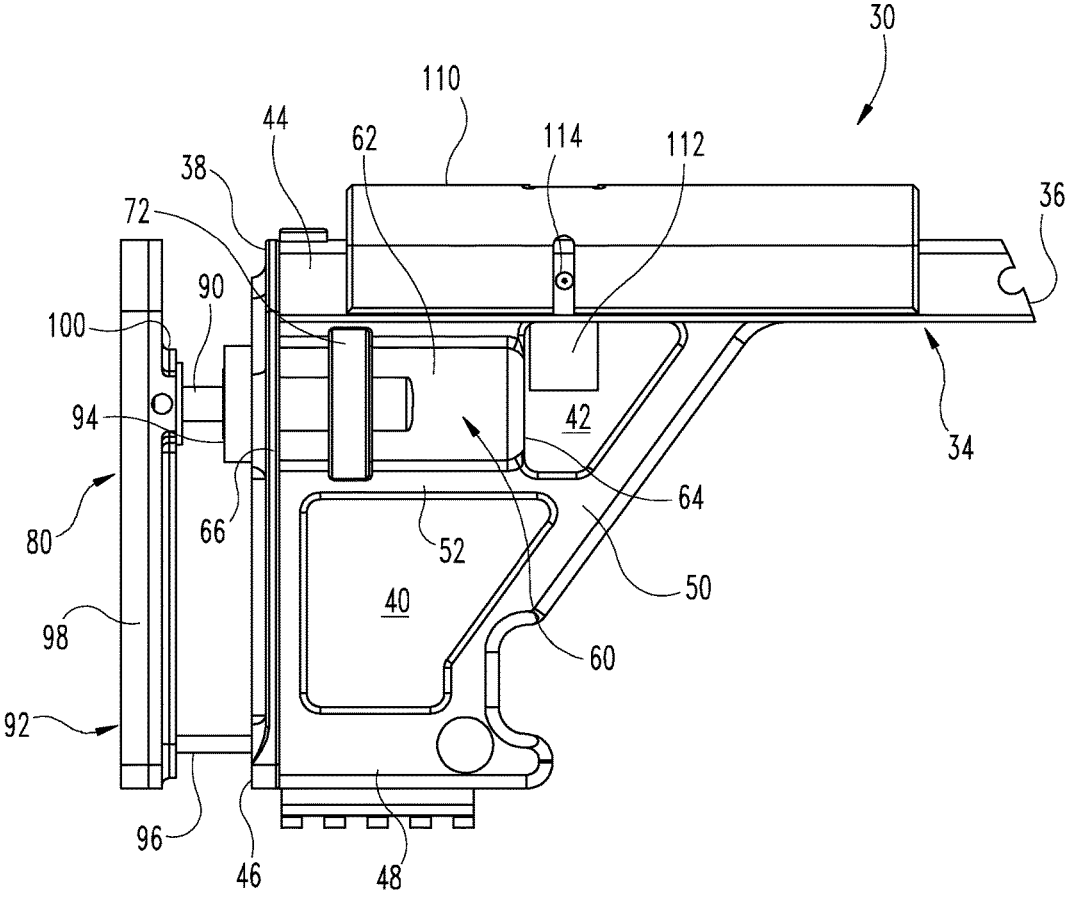
FIG. 4 is an enlarged elevation view of recoil reduction assembly and buttstock assembly of the modular stock system of FIG. 1.
Figure 5:
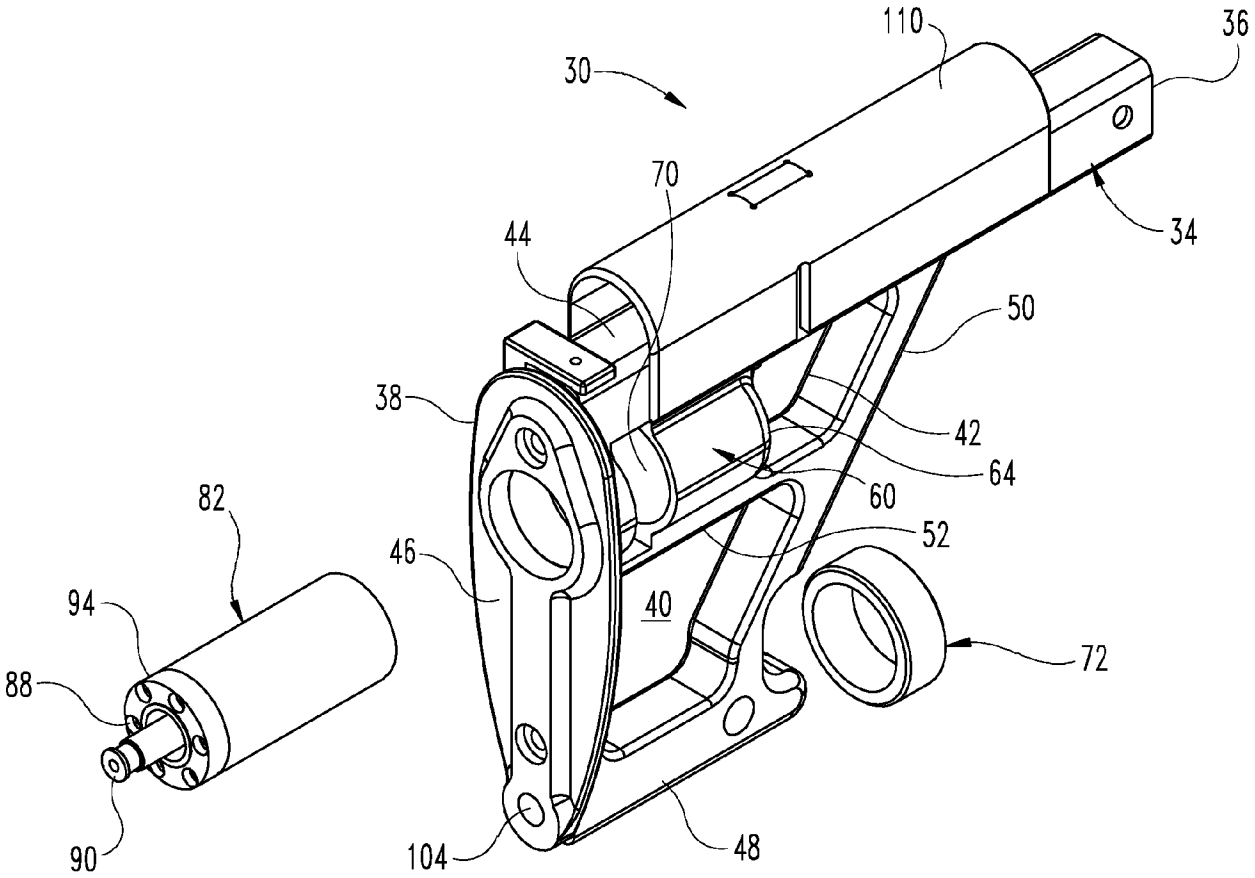
FIG. 5 is an isometric, exploded view of part of the recoil reduction assembly and the buttstock assembly of FIG. 4.

Referring further to FIGS. 4 and 5, buttstock assembly 30 includes a skeletonized body or frame 34 extending from a forward end 36 at hinge 32 and an opposite rearward end 38. As used herein, forward and forwardly refer to the direction the chassis/stock system 10 is pointing when the firearm is being aimed at a target, and rearward and rearwardly refer to the opposite direction toward the shooter. As further shown in FIG. 4, the frame 34 of buttstock assembly 30 has a reduced mass and/or surface area as compared to a solid frame, and frame 34 includes a plurality of members that define one or more laterally opening windows.

In the illustrated embodiment, there is shown a first laterally opening window 40 and a second laterally opening window 42 defined by frame 34. Frame 34 is sized and configured to provide the required structural support to transfer the force of the recoil to the recoil reduction assembly 80 (described below) without compromising the structural integrity of the buttstock assembly 30. Frame 34 can be made from a light-weight, high strength material such as, for example, aluminum, magnesium, steel, other metals and metal alloys, polymers, carbon fiber, composites, or any other suitable material. The members forming frame 34 can be solid, hollow, or combinations thereof.

Frame 34 includes an elongated housing 60 for receiving a part of recoil reduction assembly 80 to allow recoil reduction assembly 80 to be mounted to buttstock assembly 30. Housing 60 includes an outwardly projecting body portion 62 that extends outwardly from opposite sides of frame 34. Body portion 62 extends from a forward end 64 to an opposite rearward end 66. An inner bore 68 is defined by body portion 62 and opens at rearward end 66. Inner bore 68 receives a part of recoil reduction assembly 80 therein. As discussed further below, in one embodiment, the recoil reduction assembly 80 is translatable into and out of inner bore 68 to adjust the length of pull.

Frame 34 includes an upper frame member 44 extending rearwardly from forward end 36 to a rear mounting pad 46 at rearward end 38. Frame 34 also includes a lower frame member 48 extending forwardly from rear mounting pad 46 in parallel relation to upper frame member 44. Frame 34 also includes an obliquely oriented forward frame member 50 extending between the upper and lower frame members 44, 48. Frame 34 further includes an intermediate frame member 52 extending parallel to the upper and lower frame members 44, 48 that extends from the rear mounting pad 46 to the forward frame member 50.

Frame 34 defines two windows 40, 42 in the illustrated embodiment. However, other embodiments contemplate no windows, one window, or three or more windows. In the illustrated embodiment, the first window 40 is defined by the rear mounting pad 46, the lower frame member 48, the forward frame member 50, and the intermediate frame member 52. The second window 42 is defined by forward end 64 of the elongated housing 60, the intermediate frame member 52, the forward frame member 50, and the upper frame member 44. Windows 40, 42 open at each of the lateral sides of frame 34.

The elongated housing 60 is located between and extends along the upper frame member 44 and the intermediate frame member 52. In one embodiment, the elongated housing 60 is formed unitarily with the upper frame member 44 and the intermediate frame member 52. In another embodiment, the housing 60 is attached to one or more members of the frame 34.

Frame 34 further defines a slot 70 between the forward end 64 of the elongated housing 60 and the rear mounting pad 46. Buttstock assembly 30 also includes an adjustment member 72 that is received in the slot 70. In the illustrated embodiment, adjustment member 72 is a thumbwheel that is positioned around a part of recoil reduction assembly 80 in slot 70 and rotated clockwise or counterclockwise by the shooter to adjust the length of pull. In another embodiment, the adjustment member 72 is a lever or tab that is pivoted or translated by the shooter to adjust the length of pull.

Figure 6A:
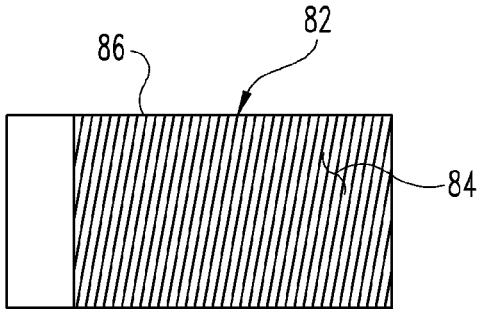
FIG. 6A is an elevation view a mounting body of the recoil reduction assembly.
Figure 6B:
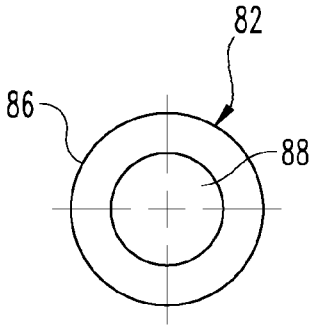
FIGS. 6B and 6C are end elevation views of the mounting body of FIG. 6A.
Figure 6C:
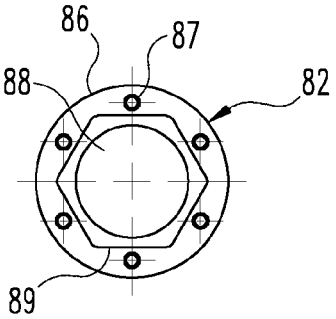

Recoil reduction assembly 80 includes a cylindrical mounting body 82 that is received in inner bore 68 of housing 60. Mounting body 82 is shown in further details in FIGS. 6A-6C. In one embodiment, the mounting body 82 includes threads 84 on an outer surface 86 of mounting body 82. The adjustment member 72 is positioned around and threadingly engaged with threads 84 of mounting body 82 when mounting body 82 is positioned in inner bore 68 of housing 60. The rearward end of mounting body can include a plurality of radially positioned, axially extending holes 87 and an internal hex shaped recess 89 for engagement of retention member 94, which allows for adjustment of the tension of recoil reduction assembly 80.

Recoil reduction assembly 80 further includes a recoil strut 90 that is positioned in a chamber 88 defined by mounting body 82. Recoil strut 90 extends rearwardly though rear mounting pad 46 to a recoil pad assembly 92. Recoil strut 90 can be employed in conjunction with a shock absorbing element in chamber 88 of mounting body 82, such as a spring, gas cylinder, air cylinder, or other recoil absorbing device (not shown). The retention member 94 can be loosened or tightened on mounting body 82 to adjust the tension of recoil reduction assembly 80.

Recoil reduction assembly 80 also includes an adjustable retention member 94 that is engaged to a rearward end of mounting body 82 to capture recoil strut 90 in chamber 88 mounting body 82 for engagement to rear mounting pad 46. Tightening or loosening of adjustable retention member 94 adjusts the tension pressure of recoil strut 90, providing for a stiffer or softer buffer depending on the adjustment that is made. In one embodiment, retention member 94 is a nut that extends through rear mounting pad 46 is rotated around recoil strut 90 to adjust the recoil resistance, but other arrangements are also contemplated. There is further provided a guide rod 96 that extends between rear mounting pad 46 and recoil pad assembly 92 to prevent or resist rotation of recoil pad assembly 92. Guide rod 96 is received in a bore 104 formed through rear mounting pad 46 and lower frame member 48 and in a hole in recoil pad assembly 92. Guide rod 96 and bore 104 extend parallel to recoil strut 90.

Recoil pad assembly 92 includes a recoil pad (not shown), a back plate 98, and an adapter plate 100. Back plate 98 attaches to the recoil pad and includes a track 102 that allows the recoil pad to be moved up or down to better fit the shooter. Adapter plate 100 attaches the back plate 98 and the recoil pad to recoil strut 90.

Buttstock assembly 30 includes a cheek piece 110 and a riser 112 that is attached to cheek piece 110 and frame 34. Riser 112 is positioned along and extends through upper frame member 44 at the forward end 64 of housing 60. Riser 112 is secured to upper frame member 44 with a fastener 114 that allows the vertical positioning of cheek piece 110 relative to upper frame member 44 to be adjusted and secured in the adjusted position. Cheek piece 110 is elongated and forms a U-shaped body that is positioned above upper frame member 44.

Figure 7:
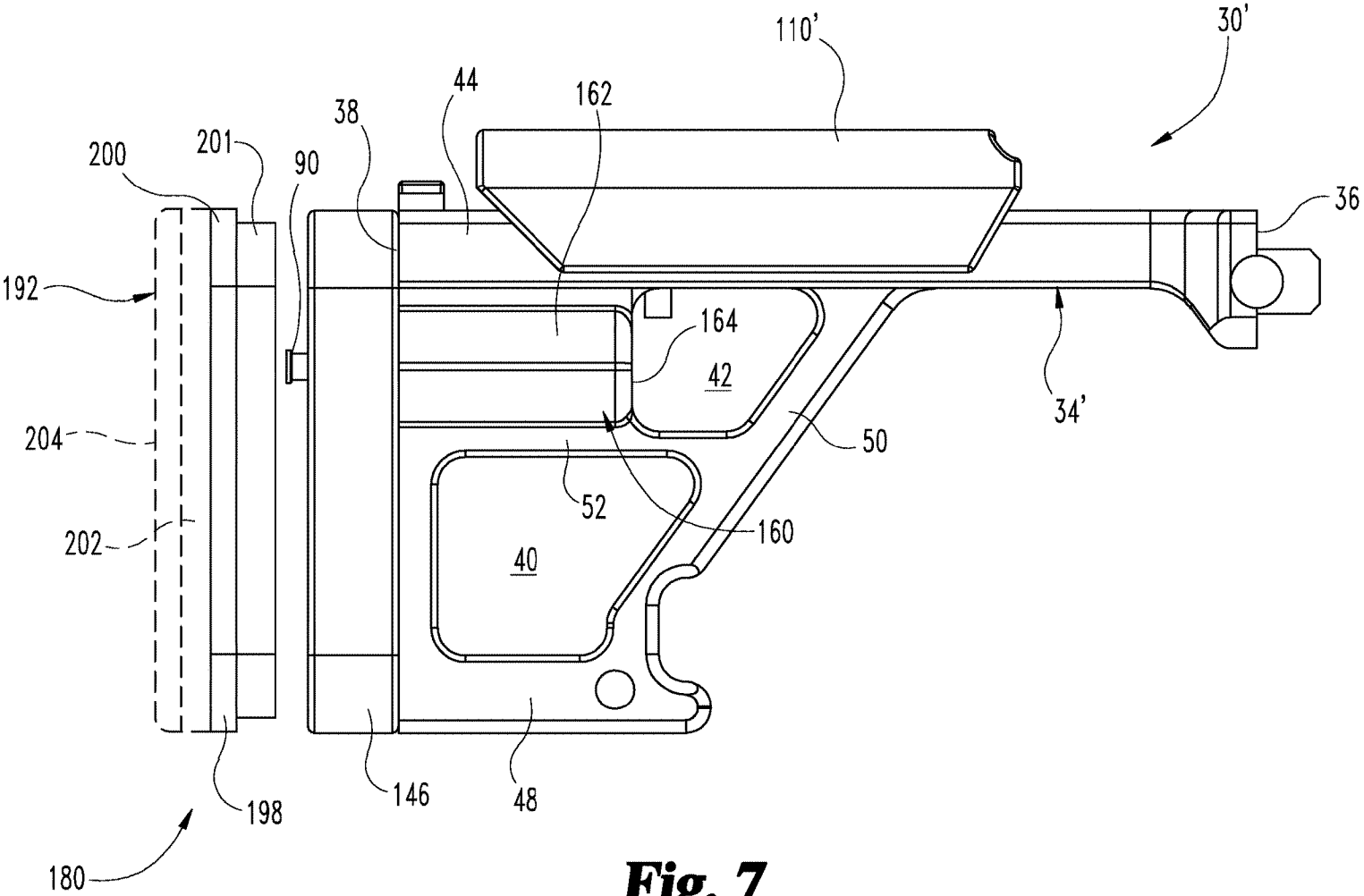
FIG. 7 is an enlarged elevation view of another embodiment of a recoil reduction assembly and buttstock assembly for a modular stock system.
Figure 8:
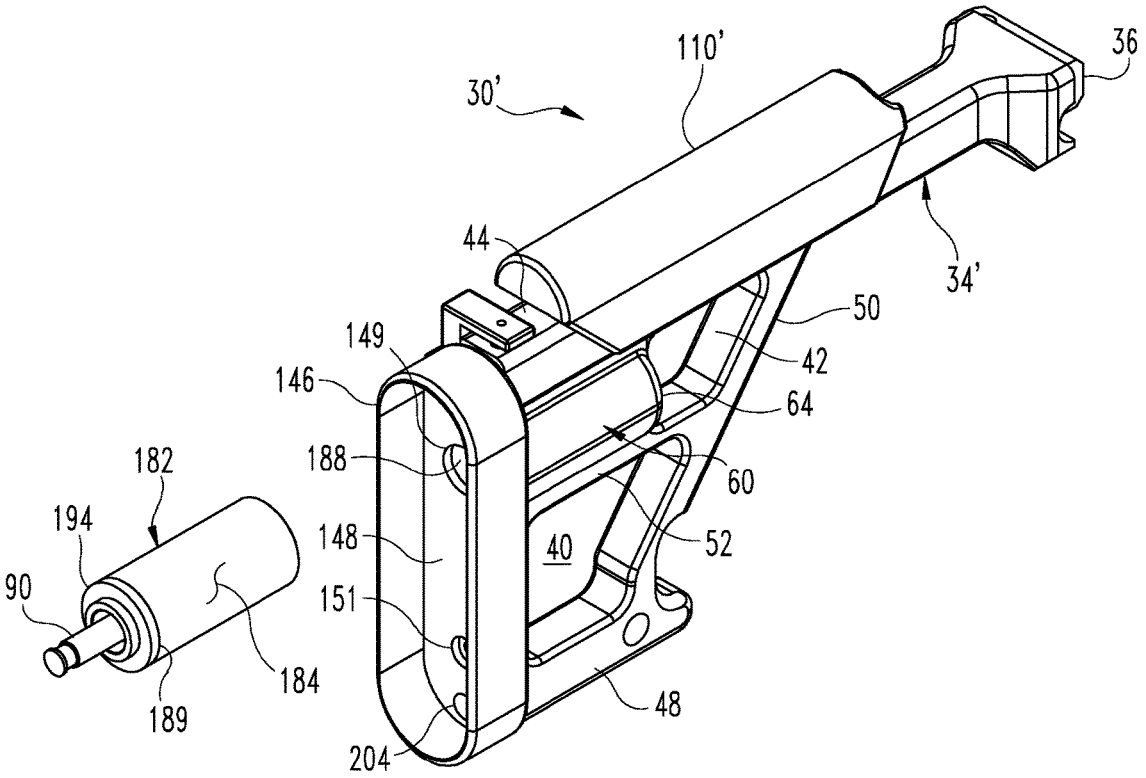
FIG. 8 is an isometric, exploded view of part of the recoil reduction assembly and the buttstock assembly of FIG. 7.
Figure 9:
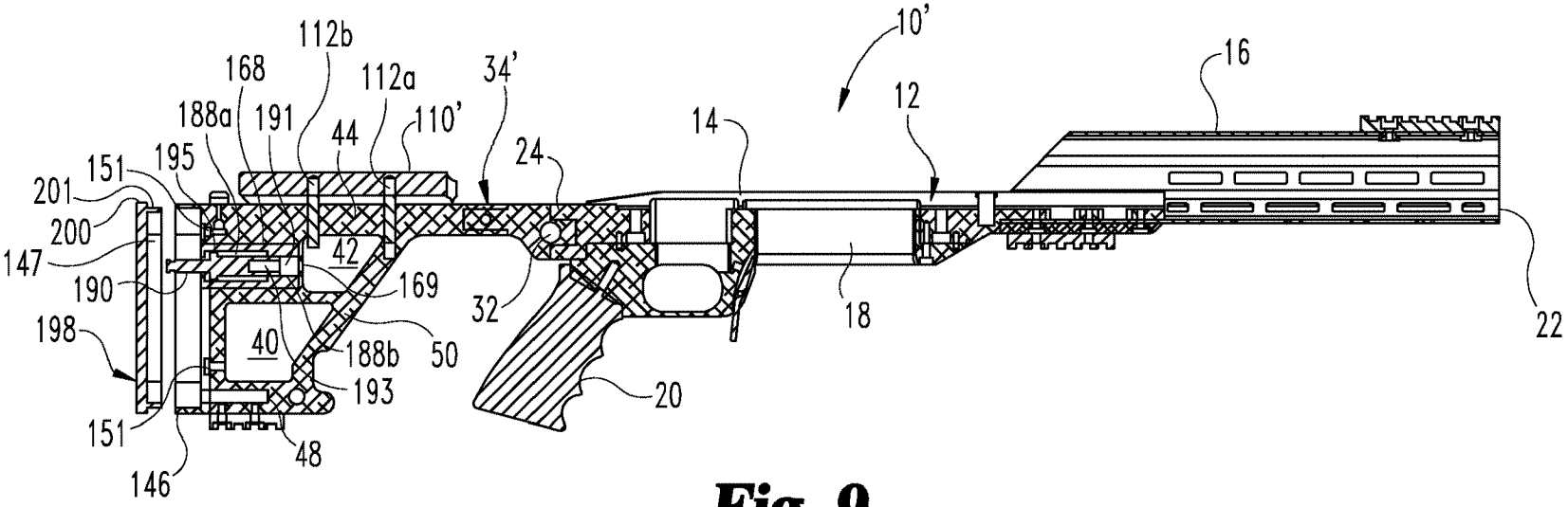
FIG. 9 is a longitudinal section view of a modular chassis/stock system for a firearm including a lower receiver structure, a handguard/accessory rail, and a buttstock assembly that incorporates the recoil reduction assembly and buttstock assembly of FIG. 7.

Referring now to FIGS. 7-9 there is shown another embodiment modular chassis/stock system 10' that includes an adjustable modular buttstock assembly 30' that is similar to or the same as modular chassis/stock system 10 and adjustable modular buttstock assembly 30 except as otherwise discussed. Therefore, elements in FIGS. 7-9 that are similar or the same as the elements in FIGS. 1-6 are designated with the same reference numeral and are not re-described herein with respect to FIGS. 7-9.

Frame 34' of buttstock assembly 30' includes an elongated cylindrical housing 160 that is located between and extends along the upper frame member 44 and the intermediate frame member 52. In one embodiment, the elongated housing 160 is formed unitarily with the upper frame member 44 and the intermediate frame member 52. In another embodiment, the housing 160 is attached to one or more members of the frame 34'. In contrast to housing 60, housing 160 does not include any slot or adjustment member, but includes an inner bore 168 defined by laterally outwardly projecting body portion 162 for receiving a part of a recoil reduction assembly 180 like housing 60. Body portion 162 of housing 160 includes a width that projects laterally outwardly from the adjoining frame members 44, 52 and a forward end wall 169 at the forward end 164 of housing 160. Forward end wall 169 extends between frame members 44, 52.

Buttstock assembly 30' includes recoil reduction assembly 180 that includes a cylindrical mounting body 182 that is received in the inner bore 168 of housing 160 as shown in FIG. 9. In one embodiment, the mounting body 182 includes a smooth or non-threaded outer surface 186. Recoil reduction assembly 180 further includes recoil strut 90 that is positioned in a chamber 188 defined by mounting body 182. Chamber 188 includes a rearward portion 188*a* and a forward portion 188*b* that is reduced in cross-sectional size relative to rearward portion 188*a*.

Recoil strut 90 extends rearwardly through a back plate 148 and a rear mounting shroud 146 to a recoil pad assembly 192. Mounting shroud 146 forms an elongated oval or racetrack shaped perimeter around an inner space 147. In the illustrated embodiment, mounting shroud 146 is formed as a unit with back plate 148 at the outer perimeter edge of back plate 148. Back plate 148 defines a hole 149 that aligns with inner bore 168 of housing 160 and also define fastener bores 151 for receiving fasteners to secure back plate 148 and mounting shroud 146 to a rearward end of frame 34'.

Recoil strut 90 can be employed in conjunction with a shock absorbing element in the chamber 188 of mounting body 182, such as a spring, gas cylinder, air cylinder, or other recoil absorbing device 191 in forward portion 188*b*. Recoil strut 190 includes a cavity 193 for receiving the shock absorbing device 191. Recoil strut 190 includes a flange 191 that is positioned in rearward portion 188*a* of chamber 188 that is in contact with or near contact with the inner wall surface of mounting body 182 to guide the reciprocating movement of recoil strut 190 in chamber 188. The retention member 194 is secured against a rearward end 189 of mounting body 182 by a back plate 148 that is mounted to the rearward end of frame 34', capturing recoil strut 90 in mounting body 182 and capturing mounting body 182 in inner bore 168 of housing 160.

Recoil pad assembly 192 includes a recoil pad 204, an optional spacer 202, and an adapter plate 200. One or more spacers 202 of selected thickness can be mounted between adapter plate 200 and recoil pad 34 to adjust the length of pull. Adapter plate 200 includes an inner flange 201 that is received in mounting shroud 146. Mounting shroud surrounds the connection to recoil strut 90 and protects the space between recoil pad assembly 192 and the rearward end of frame 34'. Adapter plate 200 attaches any spacers 202 and the recoil pad 204 to recoil strut 90.

Frame 34' also includes a cheek piece 110' that is similar to cheek piece 110 discussed above. However, cheek piece 110' includes first and second risers 112*a*, 112*b* that are attached to cheek piece 110' and frame 34'. Forward riser 112*a* extends through upper frame member 44 and into oblique frame member 50, and rearward riser 112*b* is positioned along and extends through upper frame member 44 at the forward end 164 of housing 160. Risers 112*a*, 112*b* can be secured to upper frame member 44 to allow the vertical positioning of cheek piece 110' relative to upper frame member 44 to be adjusted and secured in the adjusted position. Cheek piece 110' is elongated and forms a U-shaped body that is positioned above upper frame member 44.

From the above description it is apparent that that the construction of a firearm and/or modular chassis/stock system 10, 10' with an adjustable modular buttstock assembly 30, 30' according to the principles of the present disclosure provides a firearm with a lightweight yet highly configurable buttstock and recoil reduction assemblies while further providing for substantially quick and easy adjustment and reconfiguration of features of the buttstock and recoil reduction assemblies.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Similarly, recitation of "a," "a first" or "the" element, or the equivalent thereof, should be understood to include incorporation of one or more such elements, neither requiring nor excluding two or more such elements, unless the context clearly indicates otherwise. As used herein, the terms "having", "containing", "including", "comprising" and the like are open ended terms that indicate the presence of stated elements or features, but do not preclude additional elements or features.

While the present application illustrates various embodiments, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A modular stock system for a firearm, comprising:
a lower receiver;
a rail assembly extending forwardly from the lower receiver;
a buttstock assembly mounted rearwardly of the lower receiver, the buttstock assembly comprising:
a skeletonized frame including a substantially unitary body extending about and defining at least one laterally opening window, wherein the frame includes an upper frame member and a lower frame member, a rear mounting pad extending between the upper and lower frame members, and an obliquely oriented forward frame member extending between the upper and lower frame members, the frame further including an intermediate frame member extending parallel to the upper and lower frame members that extends from the rear mounting pad to the forward frame member, wherein the at least one window includes a first window positioned below the elongated housing and a second window positioned forwardly of the elongated housing, and the first window is defined by the rear mounting pad, the lower frame member, the forward frame member and the intermediate frame member and the second window is defined by a forward end of the elongated housing, the intermediate frame member, the forward frame member and the upper frame member;
an elongated housing extending along the frame adjacent the at least one laterally opening window, the elongated housing defining an inner bore; and
a recoil reduction assembly including a mounting body received in the inner bore of the elongated housing, the recoil reduction assembly including a recoil strut within a chamber of the mounting body, the recoil strut extending rearwardly from the mounting body, the recoil reduction assembly further including a recoil absorbing device in the chamber of the mounting body that absorbs recoil forces received by the recoil strut from a recoil pad mounted to a rearward end of the recoil strut.

2. The modular stock system of claim 1, further comprising an adjustment member positioned within the housing in engagement with the mounting body, wherein the adjustment member is operable to longitudinally adjust a position of the mounting body relative to the housing.

3. The modular stock system of claim 2, wherein the mounting body is threaded on an outer surface thereof and the adjustment member is positioned around and threadingly engaged with the mounting body.

4. The modular stock system of claim 1, further comprising:
a cheek piece mounted along an upper side of the frame with a cheek piece riser, wherein the cheek piece is vertically adjustable relative to the frame and positioned forwardly of a forward end of the elongated housing; and
a hinge pivotally connecting the adjustable buttstock assembly to the lower receiver to enable movement of the buttstock assembly with respect to the lower receiver.

5. The module stock system of claim 1, wherein the elongated housing is located between and extends along the upper frame member and the intermediate frame member.

6. The modular stock system of claim 5, wherein the elongated housing is formed unitarily with the upper frame member and the intermediate frame member.

7. The modular stock system of claim 5, wherein the housing defines a slot between a forward end and a rearward end of the elongated housing and the adjustment member is received in the slot.

8. The modular stock system of claim 1, wherein the recoil strut is longitudinally movable in the mounting body, and further comprising an adapter plate mounted to a rearward end of the recoil strut and a spacer positioned between the adapter plate and the recoil pad.

9. A buttstock assembly for a firearm, comprising:
a skeletonized frame defining one or more laterally opening windows;
an elongated housing extending along the frame adjacent the laterally opening window, the elongated housing defining an inner bore; and
a recoil reduction assembly including a mounting body received in the inner bore of the elongated housing, a recoil strut movably received in the mounting body, and a recoil pad mounted at a rearward end of the recoil strut, wherein:
the at least one window includes a first window positioned below the elongated housing and a second window positioned forwardly of the elongated housing;
the frame includes an upper frame member and a lower frame member, a rear mounting pad extending between the upper and lower frame members, and an obliquely oriented forward frame member extending between the upper and lower frame members, the frame further including an intermediate frame member between the upper and lower frame members that extends from the rear mounting pad to the forward frame member;
the first window is defined by the rear mounting pad, the lower frame member, the forward frame member and the intermediate frame member; and
the second window is defined by a forward end of the elongated housing, the intermediate frame member, the forward frame member and the upper frame member.

10. The buttstock assembly of claim 9, wherein the elongated housing is located between and extends along the upper frame member and the intermediate frame member, wherein the elongated housing is formed unitarily with the upper frame member and the intermediate frame member.

11. The buttstock assembly of claim 9, further comprising an adjustment member engaged to the mounting body that is operable to adjust a rearward/forward position of the mounting body in the elongated housing, wherein the frame defines a slot between a forward end and a rearward end of the elongated housing and the adjustment member is received in the slot.

12. The modular stock system of claim 1, further comprising a back plate mounted to a rearward end of the frame, wherein the back plate captures the recoil strut within the chamber of the mounting body and the mounting body within the inner bore of the elongated housing, the back plate including a hole through which the recoil strut extends and a mounting shroud extending rearwardly from the back plate that extends around a connection of the recoil pad to the recoil strut.

* * * * *